US005901839A

United States Patent [19]

Sasaki et al.

[11] Patent Number: 5,901,839

[45] Date of Patent: May 11, 1999

[54] SWITCHING DEVICE

[75] Inventors: Makoto Sasaki; Kouji Sato, both of Miyagi-ken, Japan

[73] Assignee: Alps Electric Co., Ltd., Japan

[21] Appl. No.: 08/938,328

[22] Filed: Sep. 26, 1997

[30] Foreign Application Priority Data

Sep. 30, 1996 [JP] Japan ..... 8-259234

[51] Int. Cl.[6] ..... H01H 15/02

[52] U.S. Cl. ..... 200/551; 200/16 R

[58] Field of Search ..... 200/4, 5 R, 5 A, 200/6 R–6 C, 16 R–16 D, 17 R, 18, 529, 547, 551, 559, 573, 574

[56] References Cited

U.S. PATENT DOCUMENTS

| | | | |
|---|---|---|---|
| 4,191,867 | 3/1980 | Feaster | 200/16 R |
| 4,447,689 | 5/1984 | Schiller | 200/330 |
| 4,918,264 | 4/1990 | Yamamoto et al. | 200/5 R |
| 5,051,552 | 9/1991 | Hou et al. | 200/549 |
| 5,384,440 | 1/1995 | Wnuk et al. | 200/5 R |
| 5,623,134 | 4/1997 | Hayakawa | 200/5 R |

*Primary Examiner*—Michael A. Friedhofer
*Attorney, Agent, or Firm*—Brinks Hofer Gilson & Lione

[57] ABSTRACT

A switching device which can operate slidably a general-purpose rocking switch by the use of the rocking switch, and achieve reduction in thickness of the device is disclosed. The switching device includes: laterally slidable sliders; levers rockably supported below the sliders by rocking fulcrums, and rocked in engagement with the sliders; and movable contacts rocked by the rocking action of the levers so as to be separated from and brought into contact with fixed contacts, wherein a pair of contact portions of the levers pressed by the sliders are set lower than the rocking fulcrums.

2 Claims, 12 Drawing Sheets

SWITCHING DEVICE

BACKGROUND OF THE INVENTION

1. Field of the Invention

The present invention relates to a switching device for use in, for example, a switch for adjusting the position of a vehicle seat back and forth, and in a power window switch, etc.

2. Description of the Related Art

Hitherto, switching devices, such as vehicle power seat switches, for adjusting the positions of a seat section and a backrest of a vehicle seat have been proposed.

In general, the vehicle seat includes a seat section and a backrest. A vehicle power seat switch provided in such a vehicle seat is composed of a knob mounted near the vehicle seat for adjusting the position of the seat section back and forth, and up and down, and another knob disposed above the knob for adjusting an inclined position of the backrest of the vehicle seat. These knobs are directly fitted to an operating shaft of a switch section incorporated into the vehicle seat. In addition, members for preventing the knobs from rattling are incorporated.

Such a vehicle power seat switch, or a switching device for a power window switch are disclosed in, for example, Japanese Examined Utility Model Publication No. 3-34814. FIG. 14 is an illustration showing a conventional switching device.

Referring to FIG. 14, the top of a wafer 70 is opened, and energizing fixed contacts 71 and switching fixed contacts 72 are arranged on the position opposite to each other, and fixed to the bottom surface of the wafer 70. The switching fixed contacts 72 are connected by a crank-shaped connecting member 73 in the wafer 70, a pair of barriers 74 disposed on the bottom surface of the wafer 70 are formed on both sides of a straight-plate portion of the connecting member 73, and the straight-plate portion of the connecting member 73 is clamped by the barriers 74. In addition, the energizing fixed contacts 71 are also connected by a crank-shaped connecting member (not shown) on the bottom surface of the wafer 70 and further, connecting fixed terminals (not shown) are adhered to the bottom surface of the wafer 70.

Substantially dogleg-shaped movable pieces 77 are incorporated into both outer parts of the barriers 74, and movable contacts 78 are adhered to both ends of the respective movable pieces 77.

On the other hand, in FIG. 14, there is shown an operating member 79 for operating the movable pieces 77. The operating member 79 has driving rods 81 at both sides of the lower end thereof which have spherical tips and are urged by a compression spring 80. The operating member 79 is arranged in a condition striding across U-shaped portions formed by cutting away the center of the upper ends of the barriers 74, and is pivotally supported by means of a supporting shaft 82 to a pair of support sections 70*a* projected at the center of both side-edges of the top opening of the wafer 70. In addition, tapered abutment portions 83 are formed at the center of the lower surface of the operating member 79, and the abutment portions 83 abut against side (stopper) portions 74*b* formed in succession with the bottom portions 74*a* of the U-shaped portions of the barriers 74 due to the inclination of the operating member 79, whereby a movement of the operating member 79 is stopped.

Further, a knob 84 is integrally formed above the operating member 79. Locking ribs 85 are formed on both sides of the knob 84 so that a knob cap 86 can be detachably mounted to the knob 84 under pressure.

According to the above conventional switching device, the rocking knob 84 to be rockably operated is disposed above the supporting shaft 82.

In some applications, it is required to make a switching device to a type in which a portion operated by an operator is slidable. However, when the switching device is arranged such that the knob 84 to be rockably operated is laterally slid by a slider, the length of the knob 84 is needed. Therefore, reduction in thickness of the device is impeded.

In addition, it is requested that a general-purpose rocking switch can be used.

SUMMARY OF THE INVENTION

It is an object of the present invention to provide a switching device which can operate slidably a general-purpose rocking switch by the use of the rocking switch, and achieve reduction in thickness of the device.

It is another object of the present invention to provide a switching device which can achieve a further reduction in thickness of the device by overlapping the slider and the lever.

In a first aspect of the present invention, there is provided a switching device, comprising: laterally slidable sliders; levers rockably supported below the sliders by rocking fulcrums, and rocked in engagement with the sliders; and movable contacts rocked by the rocking action of the levers so as to be separated from and brought into contact with fixed contacts, wherein a pair of contact portions of the levers pressed by the sliders are set lower than the rocking fulcrums.

In a second aspect of the present invention, there is provided a switching device, wherein recesses are formed on the upper surfaces of the levers, and the sliders are partially arranged in the recesses.

DESCRIPTION OF THE PREFERRED EMBODIMENT

Figure 1:
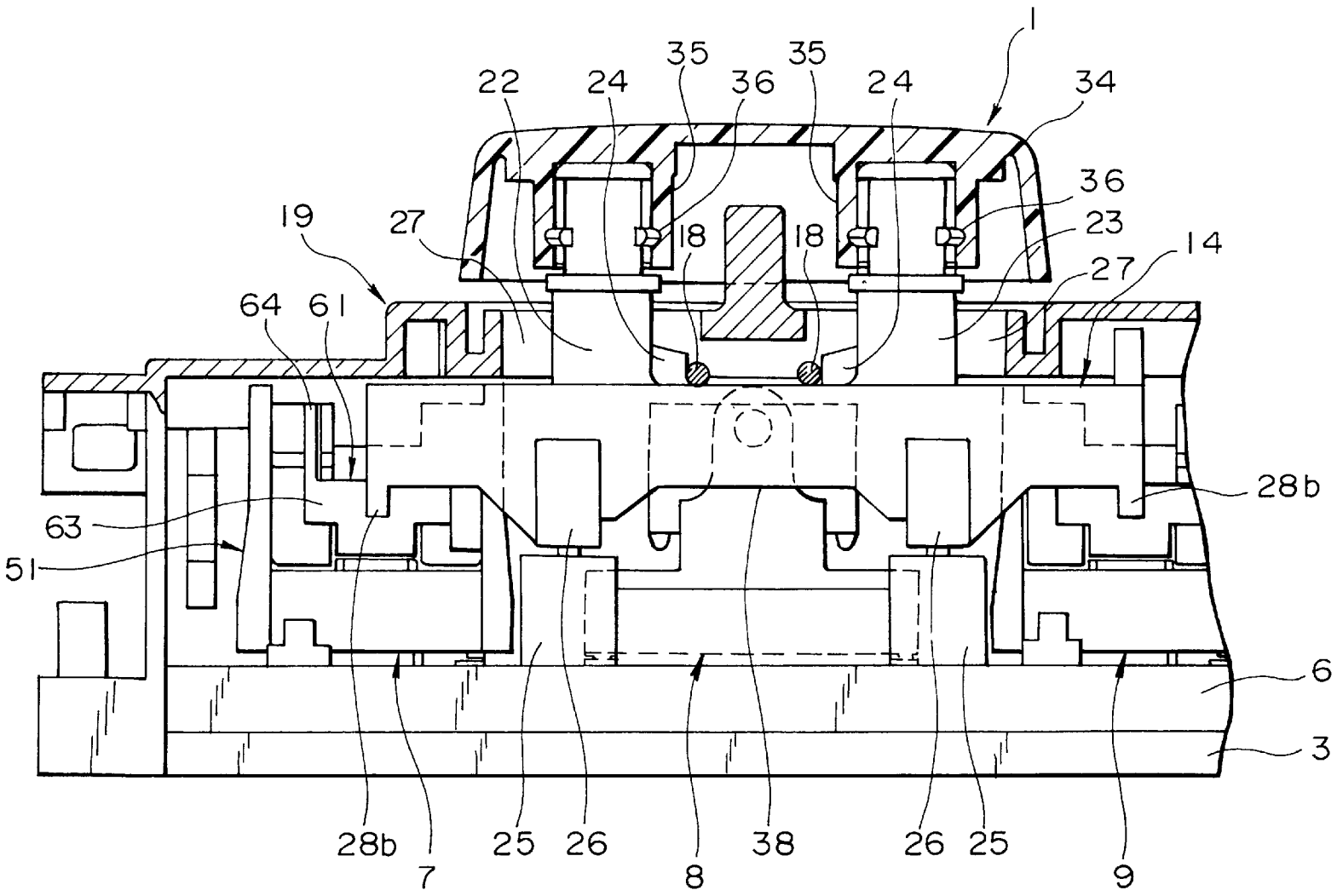
FIG. 1 is a main part sectional view showing a vehicle power seat switch as an embodiment of a switching device according to the present invention.

A vehicle power seat switch will now be described with reference to FIGS. 1 to 13 as a first embodiment of a switching device according to the present invention.

The vehicle power seat switch is mounted near a vehicle seat (not shown).

In the drawings, there are shown a seat section operating knob 1, a backrest operating knob 2, a cover 3, a first terminal 4, a second terminal 5, a wafer 6, rocking switches 7, 8, and 9 for operating the seat section, rocking switches 10 and 11 for operating the backrest, a connector 12, third to seventh terminals 13, a seat section operating slider (driver) 14, backrest operating sliders 15 and 16, a coiled spring 17, a pair of wire springs 18 and 18, a housing 19, a seat section operating rubber 20, and backrest operating rubbers 21.

The vehicle power seat switch comprises the seat section operating knob 1, and the backrest operating knob 2.

The seat section operating knob 1, the backrest operating knob 2, the seat section operating rubber 20, the backrest operating rubbers 21, and other parts except a projecting shaft of the seat section operating slider 14 and projecting shafts of the backrest operating sliders 15 and 16 are contained in a rectangular box formed by the housing 19 and the cover 3.

Two projecting shafts 22 and 23 are provided on the upper surface of the seat section operating slider 14, and projections (receivers) 24 with which the wire springs 18 are elastically brought into contact are opposingly provided at the roots of the projecting shafts 22 and 23. A pair of circular arc-shaped projections 22*a* and 23*a* are formed on the outer peripheral surface of the projecting shafts 22 and 23 along the circumferential direction thereof. The projections 24 may be provided on the seat operating knob 1.

Four guide projections 26 are formed integrally on the lower surface side of the seat section operating slider 14. The guide projections 26 are placed on slide-support projections 25 of the wafer 6 to be described later.

Figure 2:
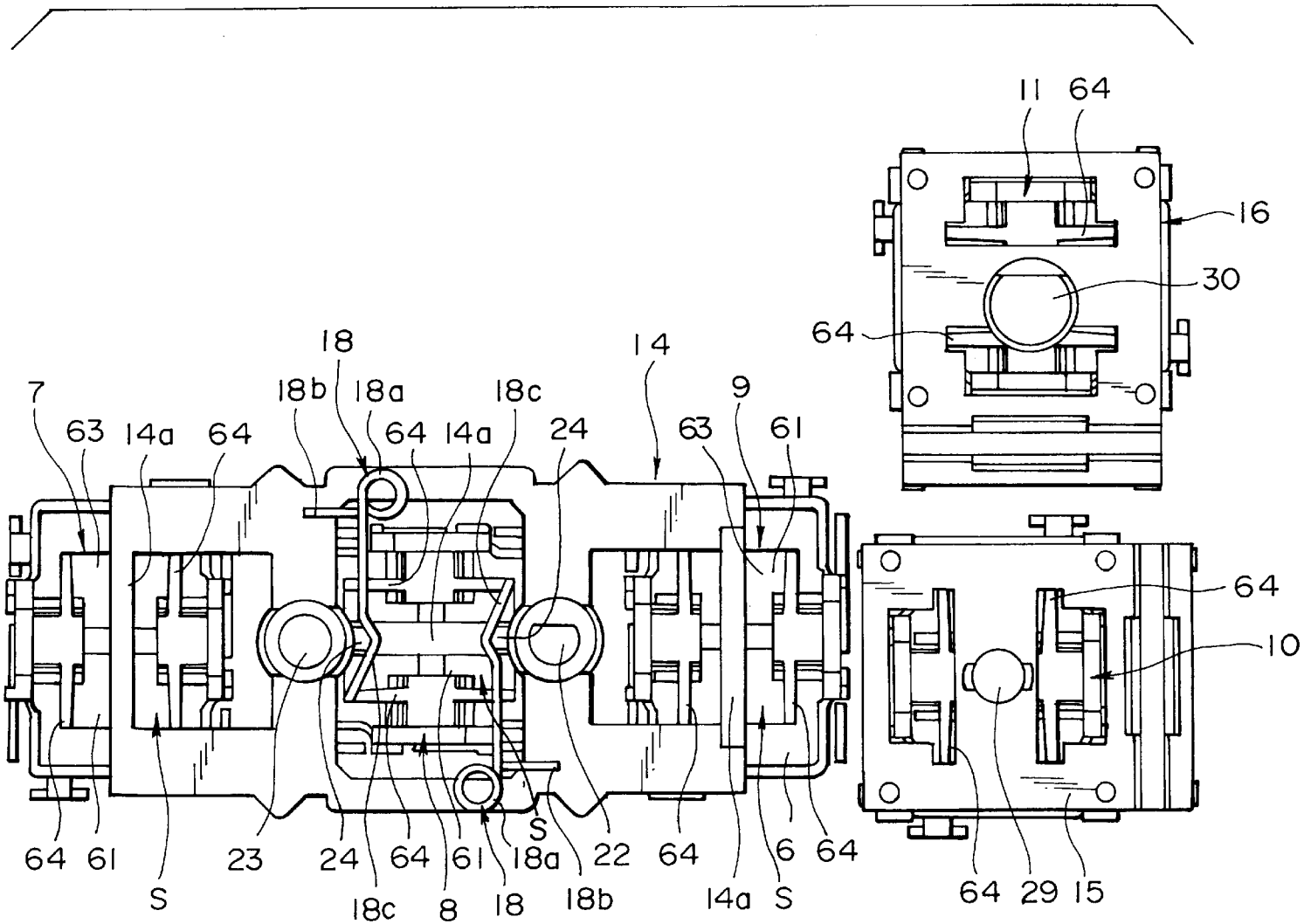
Fig. 2 is a general front view of the vehicle power seat switch in which a case thereof is omitted and wire springs are illustrated.

The seat section operating slider 14 is supported to be slidable in any direction along the surface of FIG. 2 and also the inner bottom surface of the housing 19. Therefore, the projecting shafts 22 and 23 projecting from rectangular apertures 27 of the housing 19 are also slidable in any direction within the apertures 27.

Figure 5:
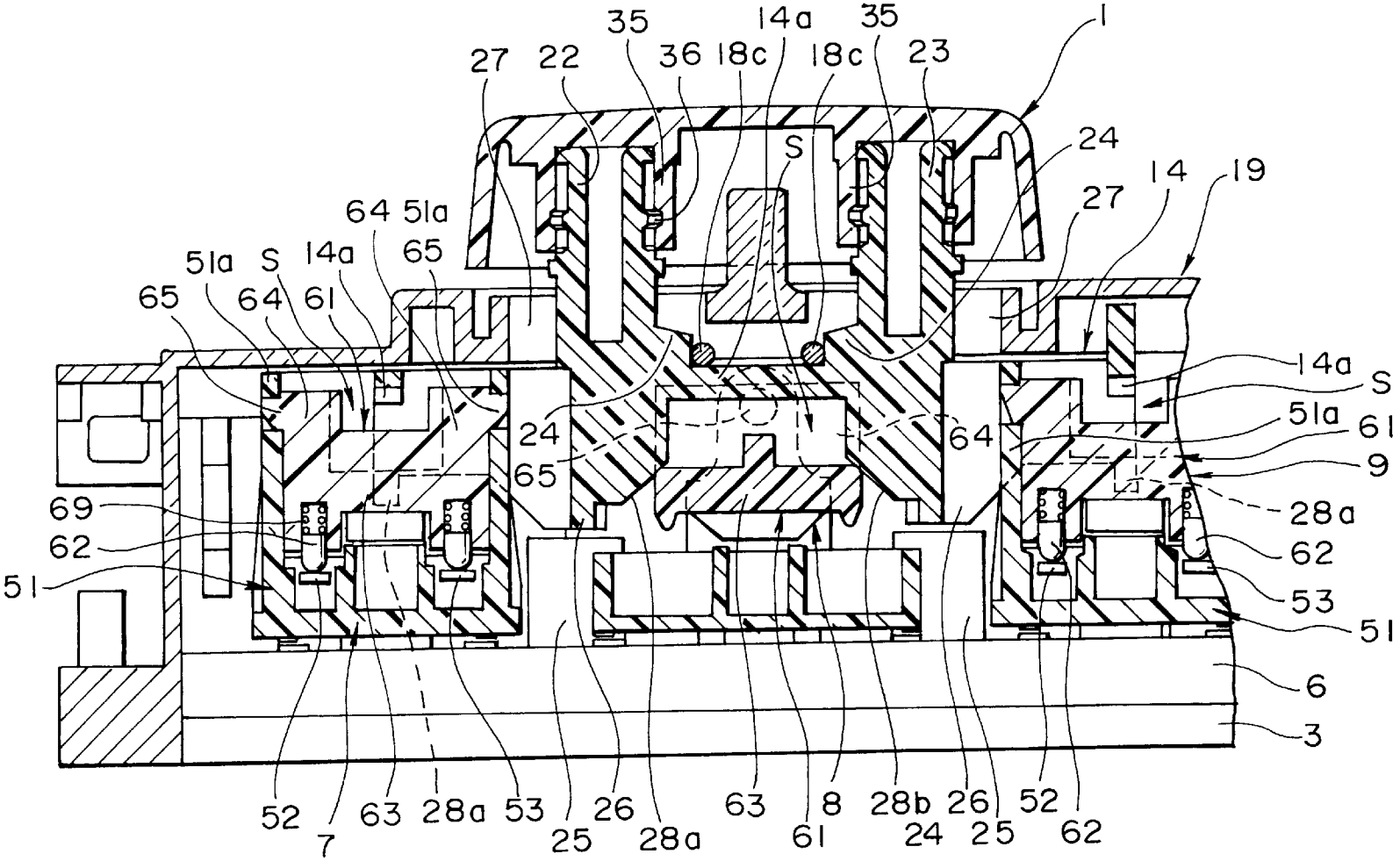
FIG. 5 is a sectional view showing a condition where the vehicle power seat switch is not operated.

The rocking switches 7, 8, and 9 for operating the seat section, which is driven by the movement of the seat section operating slider 14, are located on the lower surface side of the seat section operating slider 14 by being mounted on the wafer 6. In addition, connecting portions 14*a* are formed at the center of the slider 14 along the length thereof, and at both sides along the width thereof, and each one pair of cams 28*a* and 28*b* for actuating rocking levers 61 of the rocking switches 7, 8, and 9 are formed on respective lower ends of each connecting portion 14*a*. Each one pair of the cams 28*a* and 28*b* consist of downwardly and inwardly inclined portions, as shown in FIG. 5, and strike against both upper edges of the levers 61 when the switching device is not operated (FIG. 5). In addition, each of the connecting portions 14*a* and each one pair of cams 28*a* and 28*b* are arranged partially overlapping a recess of each lever 61. A cutout 38 is formed between the cams 28*a* and 28*b* of the central connecting portion 14*a*.

Figure 3:
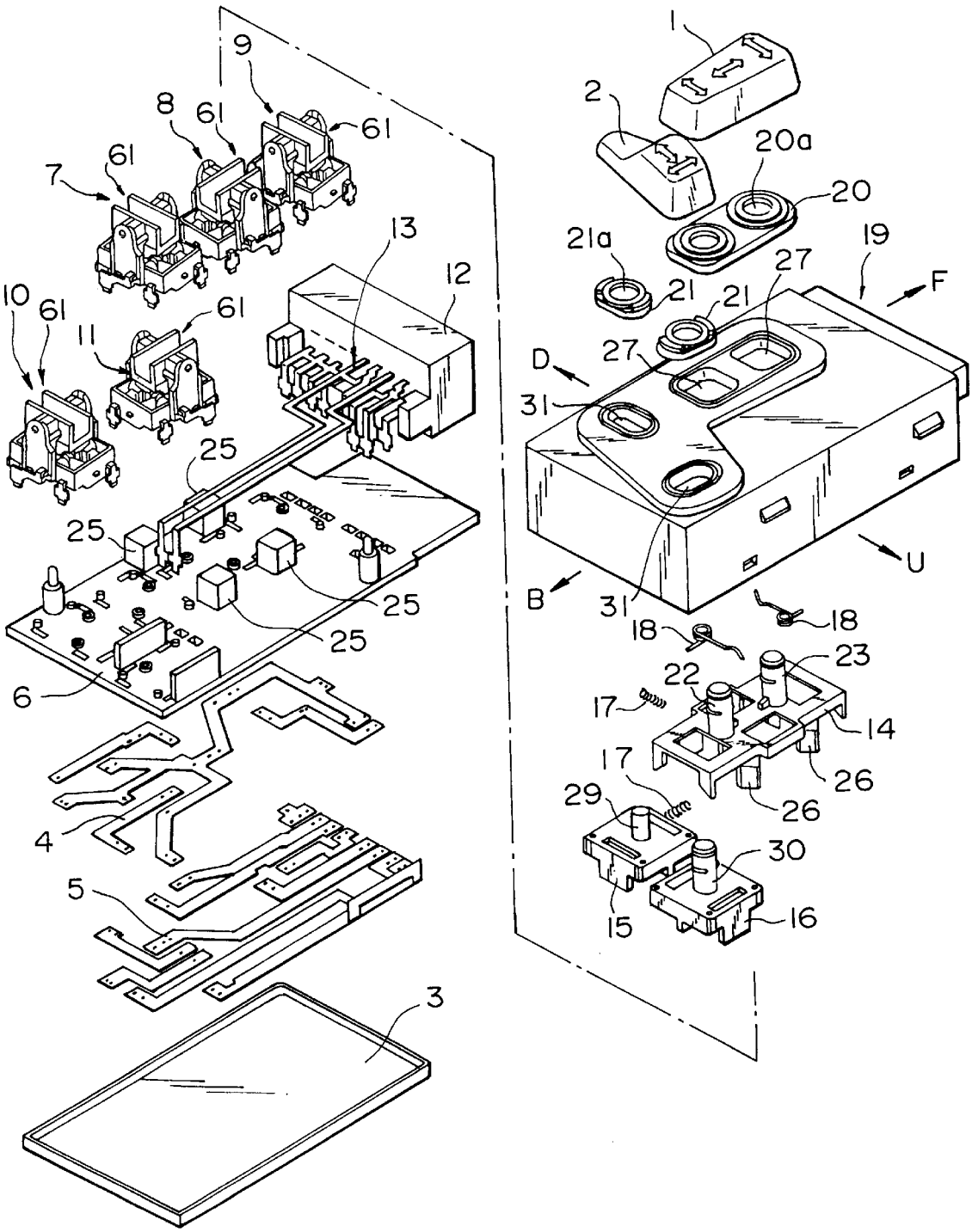
FIG. 3 is an exploded perspective view of the vehicle power seat switch.

The rocking switches 7, 8, and 9 for operating the seat section are arranged in a row, as shown in FIG. 3, etc. The lever of the central rocking switch 8 is disposed along the direction of arrangement, and the levers of the other rocking switches 7 and 9 are disposed perpendicular to the direction of arrangement. Therefore, each pair of cams 28*a* and 28*b* for the rocking switches 7 and 9 are arranged perpendicular to the pair of cams 28*a* and 28*b* for the rocking switch 8.

As shown in FIG. 2, the cams 28*a* and 28*b* at the center of the slider 14 are disposed between the side plates 64 of the lever 61 of the rocking switch 8, and cams 28*a* and 28*b* at both ends of the slider 14 are disposed between the side plates 64 of the rocking switches 7 and 9, respectively. Therefore, when the seat section operating slider 14 is slid from side to side of FIG. 2, the lever 61 of the rocking switch 8 is rocked by the cams 28*a* and 28*b* formed at the center of the slider 14, but the cams 28*a* and 28*b* formed at both ends of the slider 14 merely slide in each of the spaces formed between the side plates 64 of the levers 61 of the rocking switches 7 and 9, and the levers 61 thereof are not rocked.

Projecting shafts 29 and 30 are provided on the upper surface of the backrest operating sliders 15 and 16, respectively, and a pair of circular arc-shaped ribs 29*a*, and a pair of circular arc-shaped ribs 30*a* are provided on the projecting shafts 29 and 30, respectively. In addition, the rocking switches 10 and 11 for operating the backrest, which is driven by the movement of the backrest operating sliders 15 and 16, are located on the lower surface sides of the backrest operating sliders 15 and 16 by being mounted on the wafer 6.

The sliders 15 and 16 are supported to be slidable in one direction perpendicular to each other, and hence the projecting shafts 29 and 30 are slidable in one direction perpendicular to each other.

The seat section operating knob 1 is fitted to the tips of the projecting shafts 22 and 23 of the seat section operating slider 14. The knob 1 is arranged horizontally when actually installed in a vehicle. On the other hand, the projecting shafts 29 and 30 of the backrest operating sliders 15 and 16 are arranged in the direction perpendicular to the seat section operating knob 1 when actually installed in the vehicle, and the backrest operating knob 2 is also fitted to the projecting shafts 29 and 30. The vehicle power seat switch is arranged, for example in a condition where the arrow F side shown in FIG. 3 is placed in front of the vehicle, the arrow B side is placed at the back of the vehicle, the arrow U side is placed upward, and the arrow D side is placed downward.

Figure 7:
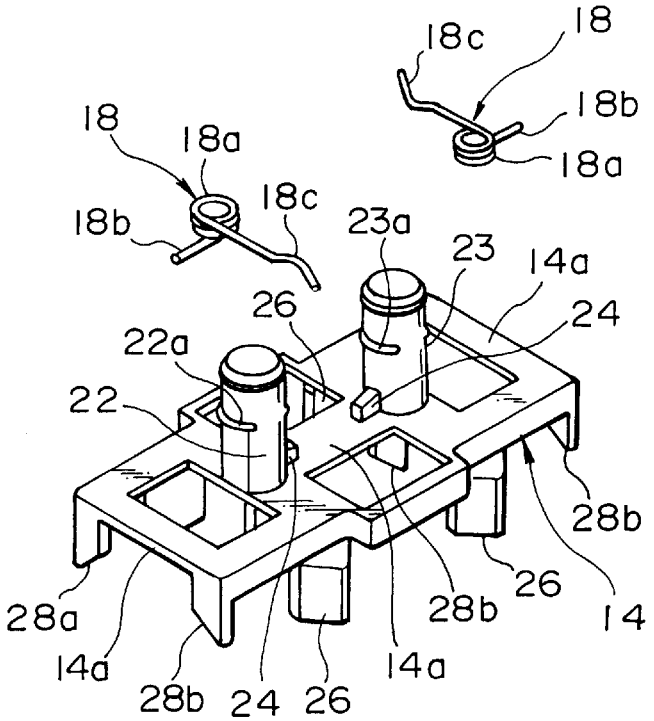
FIG. 7 is a perspective view of a slider of the vehicle power seat switch.
Figure 8:
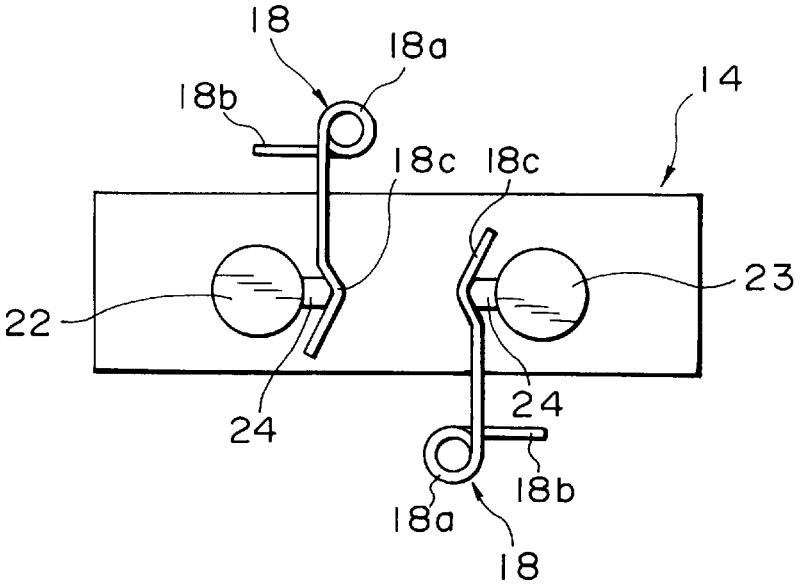
FIG. 8 is an illustration showing schematically the relationship between the slider and the wire springs.

A pair of the wire springs 18, as shown in FIGS. 2 and 7, consist of coiled portions 18*a*, one end locking portions 18*b* drawn from the coiled portion 18*a*, and the other end press-contact portions 18*c*. The press-contact portions 18*c* are warped in the form of a circular-arc at the sections near the tips thereof, and projections 24 and 24 of the projecting shafts 22 and 23 of the seat section operating slider 14 are elastically brought into contact with the warped sections, respectively.

Figure 4:
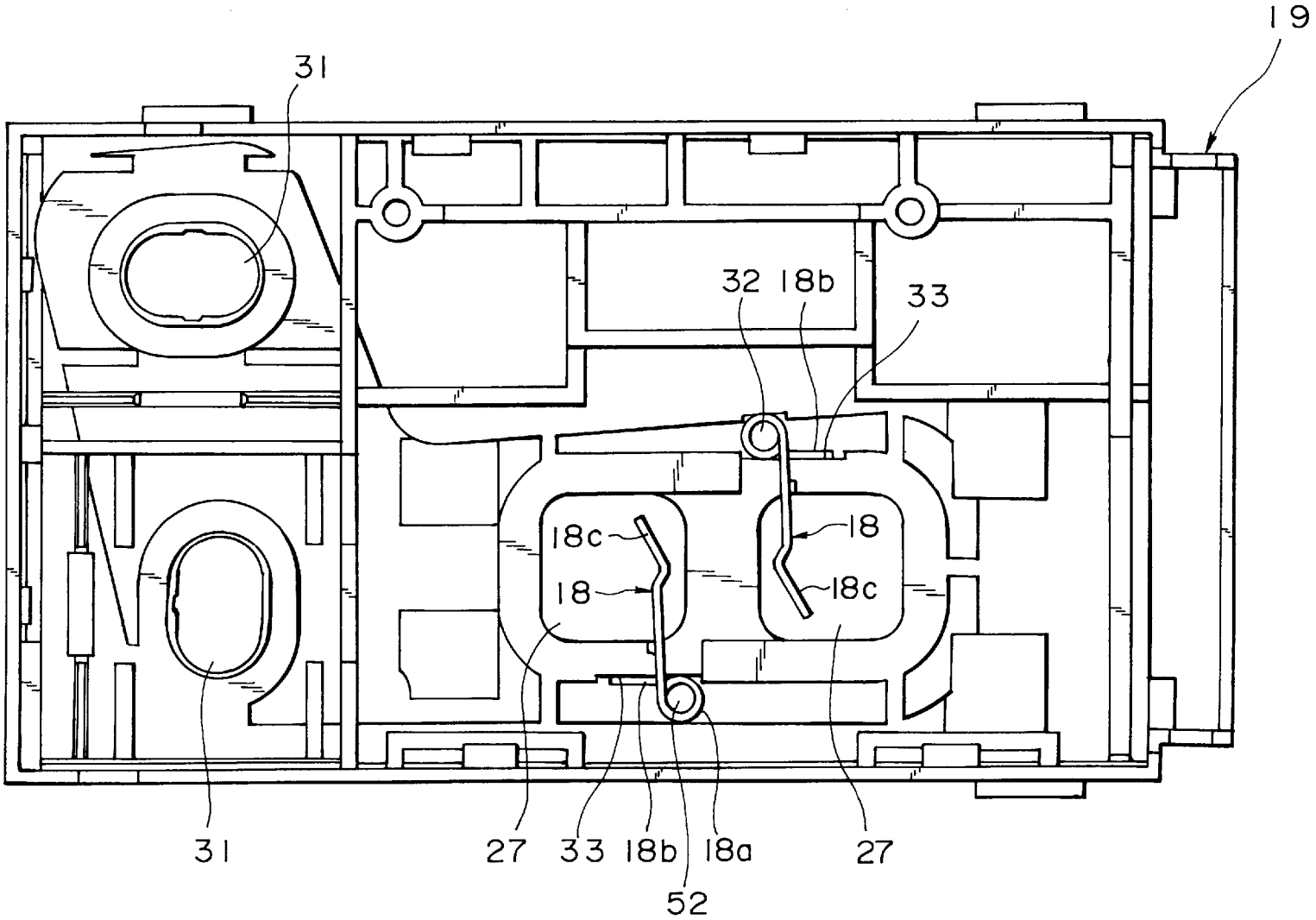
FIG. 4 is a bottom view of a housing to which the wire springs shown in FIG. 3 are mounted.

The lower portion of the housing 19 is formed in the shape of an opened rectangular box, and apertures 27 and 31 are formed in the upper plate surface thereof, as shown in FIG. 3. In addition, as shown in FIG. 4, on the inner bottom surface of the housing 19, pins 32 to which the coiled portions 18*a* of the wire springs 18 are fitted are projected at both sides of the apertures 27, ribs are formed around the apertures 27, and the locking portions 18*b* of the wire springs 18 strike against the outer wall surfaces 33 of the ribs. A pair of the wire springs 18 are elastically brought into contact with the projections 24 of the projecting shafts 22 and 23 of the seat section operating slider 14 in a condition where they are mounted to the housing 19, and urging forces of the press-contact portions 18*c* are opposing to each other. As described above, the urging directions of each of the press-contact portions 18*c* are opposed to each other and the press-contact portions 18*c* are formed into the shape of the circular arc, so that urging forces are applied to the projections 24 of the projecting shafts 22 and 23 even if the slider 14 moves in any direction, for example, in the vertical direction of FIG. 4, thereby preventing the shafts 22 and 23 from rattling.

The first terminal 4 and the second terminal 5 are formed in two-layer arrangement, and connected and fixed to the lower surface of the wafer 6 by caulking, etc., and the connector 12, the rocking switches 7, 8, and 9 for operating the seat section, and the rocking switches 10 and 11 for operating the backrest are connected and fixed to the upper surface of the wafer 6 by caulking, etc. In addition, the third to seventh terminals 13 for connecting the connector 12 to each of the components are provided on the upper surface of the wafer 6.

Further, four slide-support projections 25 in the form of quadrangular prism are provided on the upper surface of the wafer 6 to clamp the seat section operating slider 14 together with the inner bottom surface of the housing, whereby the slider 14 is slidably supported without inclining in any direction of up and down, and left and right.

The seat section operating knob 1 is made of synthetic resin, and comprises an outer shell 34, and cylindrical parts 35 provided in the underside of the outer shell 34 into which the projecting shafts 22 and 23 of the slider 14 are fitted. In the inner peripheral surfaces of the cylindrical parts 35, grooves 36 are provided along the circumferential direction thereof with which the projections 22*a* and 23*a* of the projecting shafts 22 and 23 are engaged.

In addition, the backrest operating knob 2 is also made of synthetic resin, and comprises an outer shell (not shown) and two cylindrical parts (not shown) provided in the underside of the outer shell into which the projecting shafts 29 and 30 of the backrest operating sliders 15 and 16 are fitted. In the inner peripheral surfaces of the cylindrical parts, grooves 36 are provided along the circumferential direction thereof with which the ribs 29*a* and 30*a* of the projecting shafts 29 and 30 are engaged.

The seat section operating rubber 20, and the backrest operating rubbers 21 are made of, for example rubber materials, and circular holes 20*a* and 21*a* through which the projecting shafts 22 and 23, and 29 and 30 are passed are punched therein, whereby the apertures 27 and 31 of the housing 19 from which the projecting shafts 22 and 23, and 29 and 30 are projected are filled up so as to prevent the ingress of foreign materials such as dust, or water.

The rocking switches used in the rocking switches 7, 8, and 9 for operating the seat section, and the rocking switches 10 and 11 for operating the backrest will now be described with reference to FIGS. 10 to 13.

Since other rocking switches 7 and 9, and 10 and 11 are similar to the rocking switch 8, the descriptions thereof are omitted.

Figure 11:
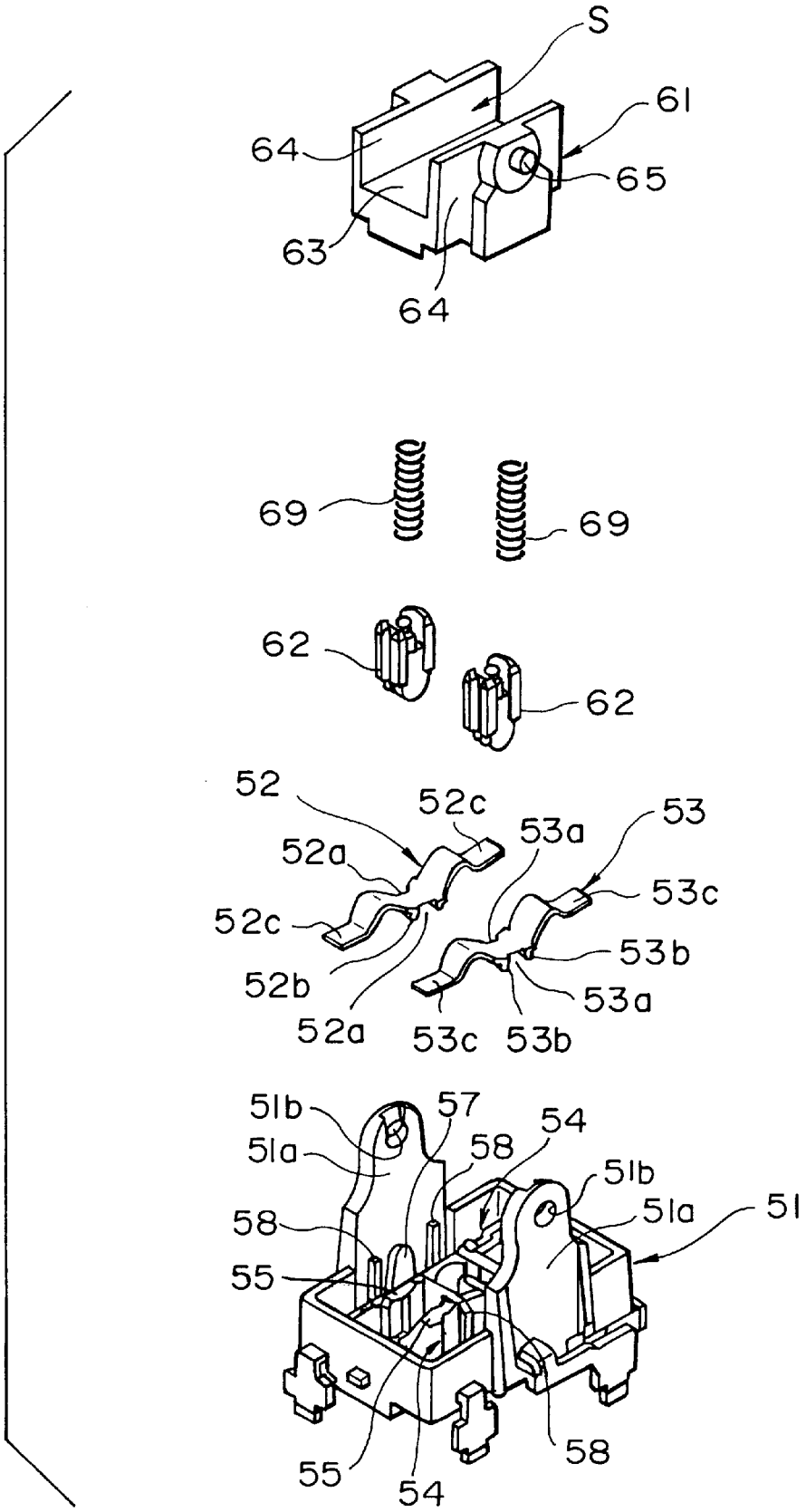
FIG. 11 is an exploded perspective view of the rocking switch.
Figure 13:
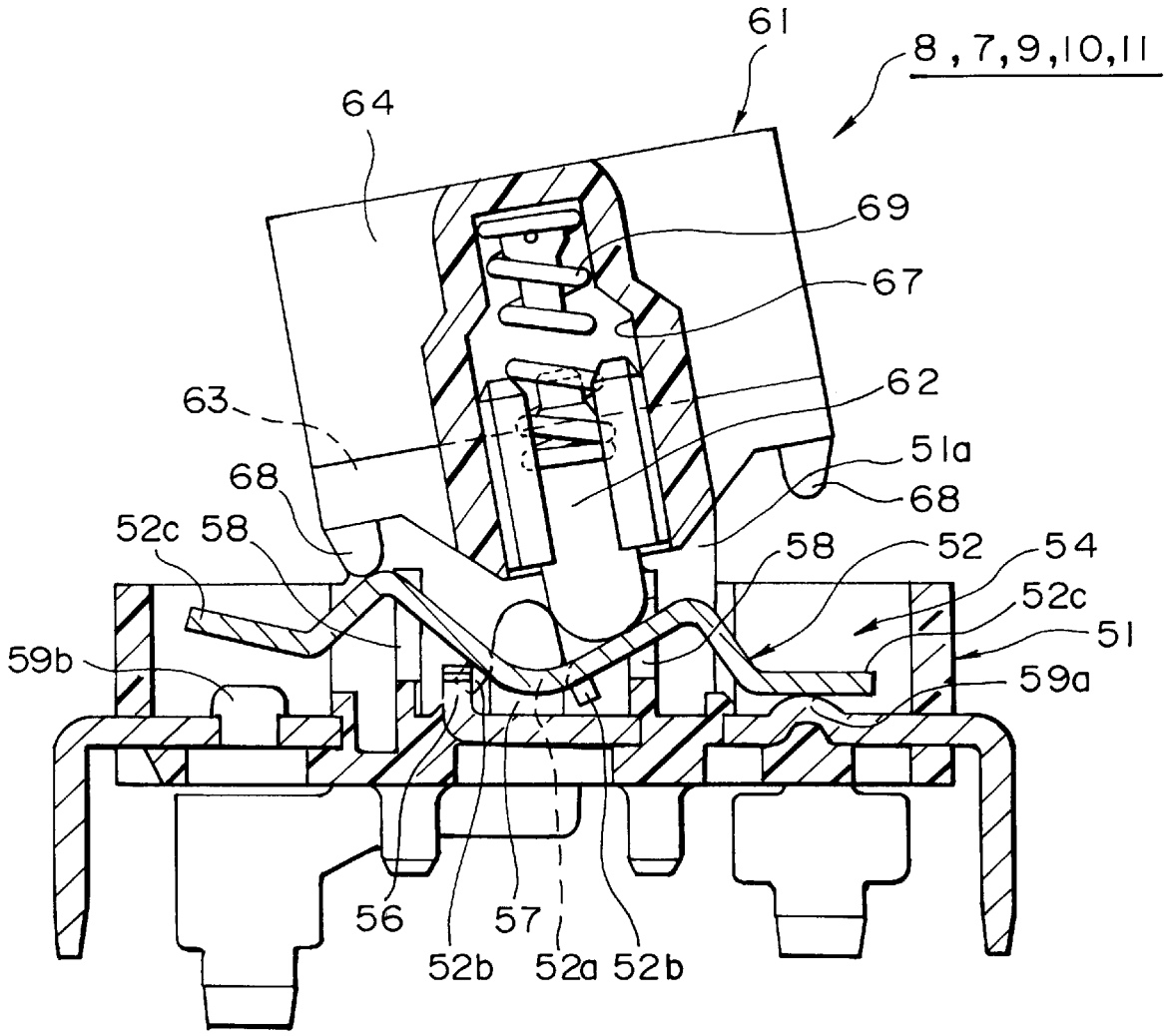
FIG. 13 illustrates a condition where the lever of the rocking switch is tilted.
Figure 14:
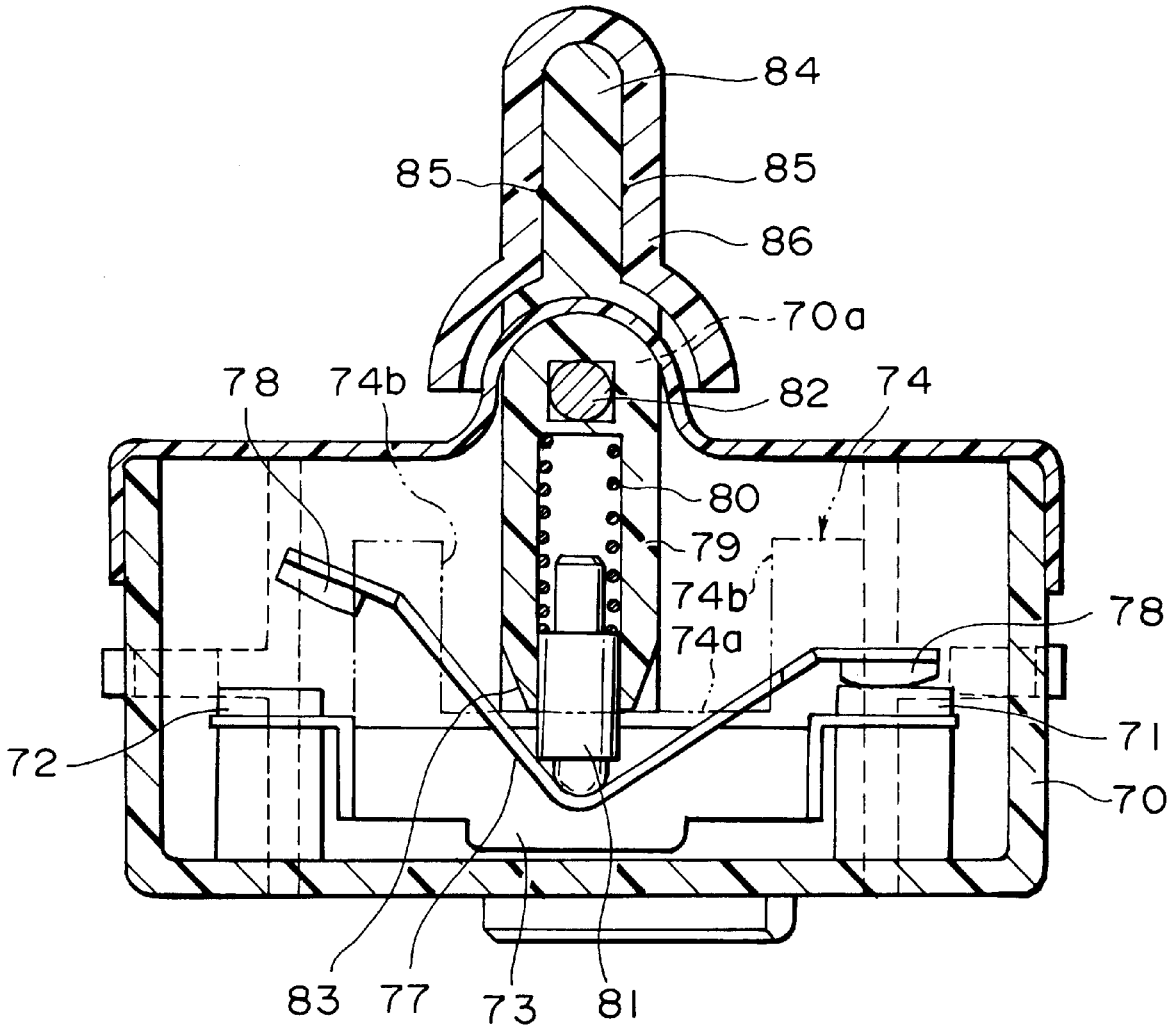
FIG. 14 PRIOR ART
FIG. 14 is an illustration showing a conventional switching device.

As shown in FIGS. 11 and 13, the rocking switch 8, which is a kind of general-purpose switches, has a base 51. In the base 51, walls 55 for forming storage sections 54 in which a first and a second movable contact pieces 52 and 53 are separately stored are integrally formed between side plates 51*a*. Shaft holes 51*b* for rockably supporting the lever 61 are formed in the upper portions of the side plates 51*a*.

In one of the storage sections 54, there are disposed a central support plate 56 for supporting a substantially middle portion of the first movable contact piece 52, a control projection 57 to which cutouts formed in both side-edges at the center of the first movable contact piece 52 are fitted, projections 58 projected to form recesses on both sides of the control projection 57, and first fixed contacts 59*a* and 59*b* which are brought into contact with both ends of the first movable contact piece 52 when it is rocked.

In addition, in the other storage section 54, similar to the above storage section 54, there are stored a central support plate 56 for supporting a substantially middle portion of the second movable contact piece 53, a control projection 57 to which cutouts formed in both side edges at the center of the second movable contact piece 53 are fitted, projections 58 projected to form recesses on both sides of the control projection 57, and second fixed contacts 60*a* and 60*b* which are brought into contact with both ends of the second movable contact piece 53 when it is rocked. Both central support plates 56 are arranged in the direction opposite to each other. Therefore, although a vertical cross section of the first movable contact piece 52 is shown in FIG. 2, the cross section of the second movable contact piece 53 is reversed from right to left of FIG. 13. In a condition of the lever 61 shown in FIG. 13, the second movable contact piece 53 is in contact with the second contact 60*b*, but is not in contact with the second fixed contact 60*a*.

The first and second movable contact pieces 52 and 53 are provided with cutouts 52*a* and 53*a* formed in both side edges at the center thereof, cut and raised pieces 52*b* and 53*b* for forming cutouts 52*a* and 53*a*, and contact portions 52*c* and 53*c* of which both ends are extended so as to be separated from and brought into contact with the first contacts 59*a* and 59*b*, and the second contacts 60*a* and 60*b*. The first and second movable contact pieces 52 and 53 are rockably supported by a rising portion 56*a* of the central support plate 56 near the center of the lower surfaces thereof. On the other hand, driving rods 62 are slid on the upper surfaces of the first and second movable contact pieces 52 and 53 while being pressed into contact therewith.

The lever 61 consists of a bottom plate 63, and a pair of side plates 64 raised from both edges thereof. Shafts 65 to be inserted into the shaft holes 51*b* are projected from the outer surfaces at the tops of the side plates 64, respectively. The pair of cams 28*a* and 28*b* of the seat section operating slider 14 are engaged with both rocking upper edges of the bottom plate 63 of the lever 61 so as to rock the lever 61 by means of the sliding action of the slider 14. Projections 66 formed on both rocking lower edges of the bottom plate 63 abut against the upper end surface of the base 51 so as to control excessive rocking of the lever 61. Referring to FIG. 13, there are shown a storage hole 67 for storing the driving rod 62 through a coil spring 69, and projections 68 formed at both lower edges of the lever 61 in the direction of rocking.

The operation of the rocking switch will now be described.

At a neutral position of the lever 61 (shown in FIGS. 5 and 12) where the seat section operating knob 1 is not operated, one end of the first movable contact piece 52 is in contact with one fixed contact 59*b* of the first fixed contacts 59*a* and 59*b*. In addition, at the neutral position, one end of the second movable contact piece 53 is in contact with one fixed contact 60*a* of the second fixed contacts 60*a* and 60*b*, and both switch sections are turned off.

When the seat section operating knob 1 is operated to rotate the lever 61 counterclockwise from the condition as described above, one driving rod 62 slides on the first movable contact piece 52 toward the first fixed contact 59*a* while pressing the first movable contact piece 52. When the driving rod 62 crosses over the central support plate 56, the first movable contact piece 52 rocks clockwise about the central support plate 56, so that the other end of the first movable contact piece 52 comes into contact with the first fixed contact 59*a* and does not come into contact with the other fixed contact 59*b*, as shown in FIG. 13, whereby a switching operation of one switch section is performed. Although the other driving rod 6 also slides on the second movable contact piece 53 toward the fixed contact 60*a* by the rotation of the lever 61, the second movable contact piece 53 does not rock because it is already in contact with the second fixed contact 60*a*, so that the switching operation of the other switch section is not performed.

Figure 12A:
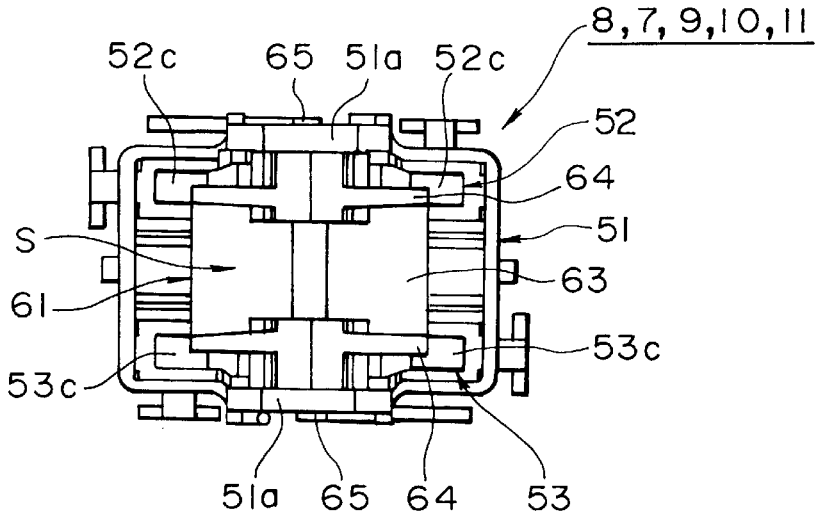
FIG. 12A is a plan view of the rocking switch.
Figure 12B:
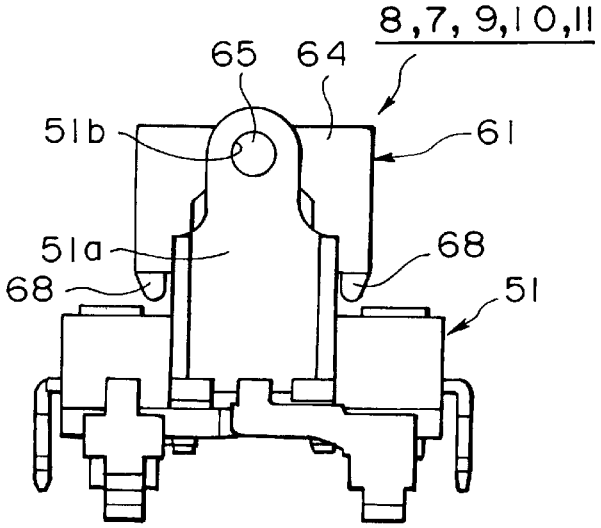
FIG. 12B is a front view of the rocking switch.
Figure 12C:
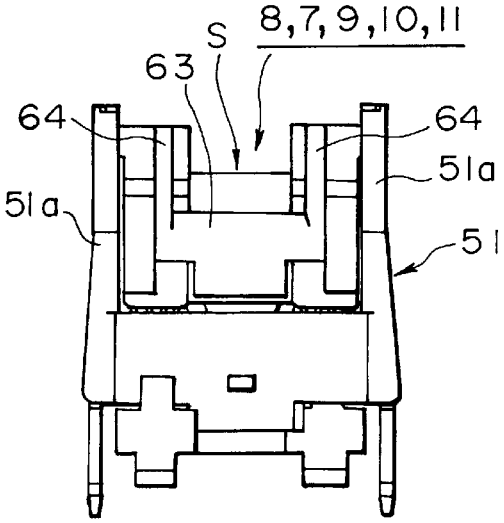
FIG. 12C is a side view of the rocking switch.

Contrary to the above description, when the lever 61 is rotated clockwise from the condition shown in FIG. 12, the switching operation of the other switch section is performed, and the switching operation of one switch section is not performed.

The relationship between the rocking switches 7, 8, and 9 for operating the seat section and the seat section operating slider 14, or the relationship between the rocking switches 10 and 11 for operating the backrest and the backrest operating sliders 15 and 16 will now be described.

Figure 9:
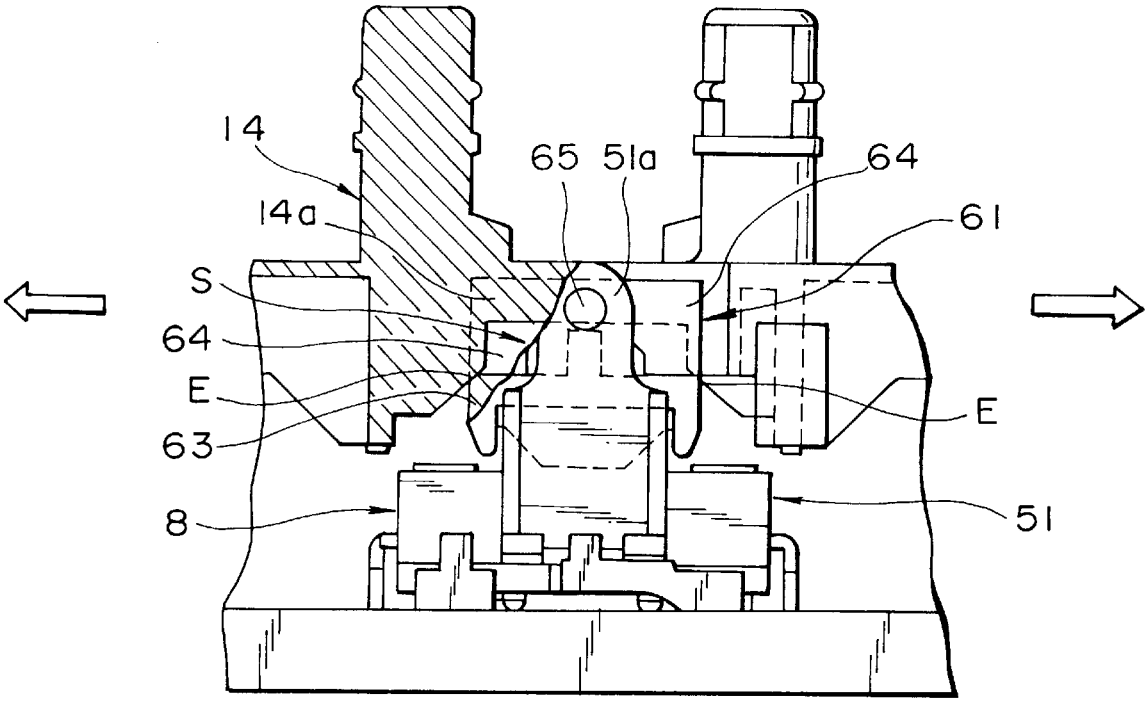
FIG. 9 is a partially cutaway illustration of the slider and a lever of a rocking switch.
Figure 10:
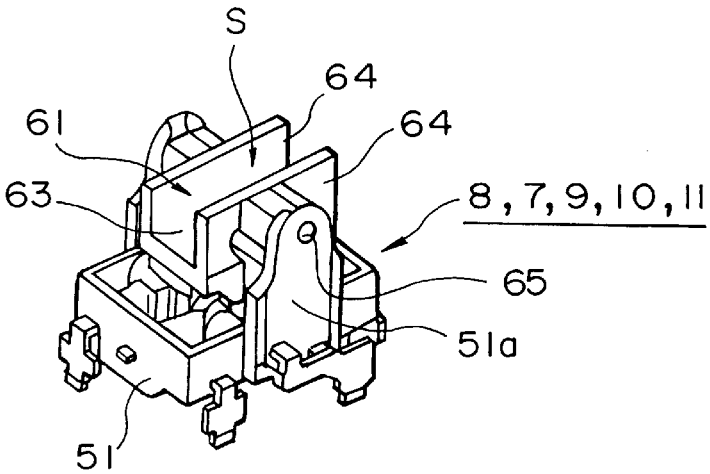
FIG. 10 is a perspective view of the rocking switch.

The lever 61 of the rocking switch 8 rocks around the shaft 65. However, as shown in FIG. 9, the both rocking upper edges of the bottom plate 63 of the lever 61 with which the pair of cams 28*a* and 28*b* of the slider 14 are engaged are set lower than the shaft 65. Therefore, since a point of application (E) to which operating force of the lever 61 of the rocking switch 8 is applied is lower than the shaft 65, the height of the rocking switch 8 can be lowered, so that reduction in thickness of the switching device can be achieved.

Further, the recess S surrounded by the side plates 64 is formed on the bottom plate 63 of the lever 61 of the rocking switch 8, and the connecting portion 14*a* of the slider 14 and the pair of cams 28*a* and 28*b* are partially overlapped the recess S, whereby a further reduction in thickness of the switching device can be achieved. The side plates 64 may not be provided in the recess S.

The relationship between the slider 14 and other switches 7 and 9, or the relationship between the switches 10 and 11 and the backrest operating sliders 15 and 16 are the same as that between the rocking switch 8 and the slider 14 as described above.

Figure 6:
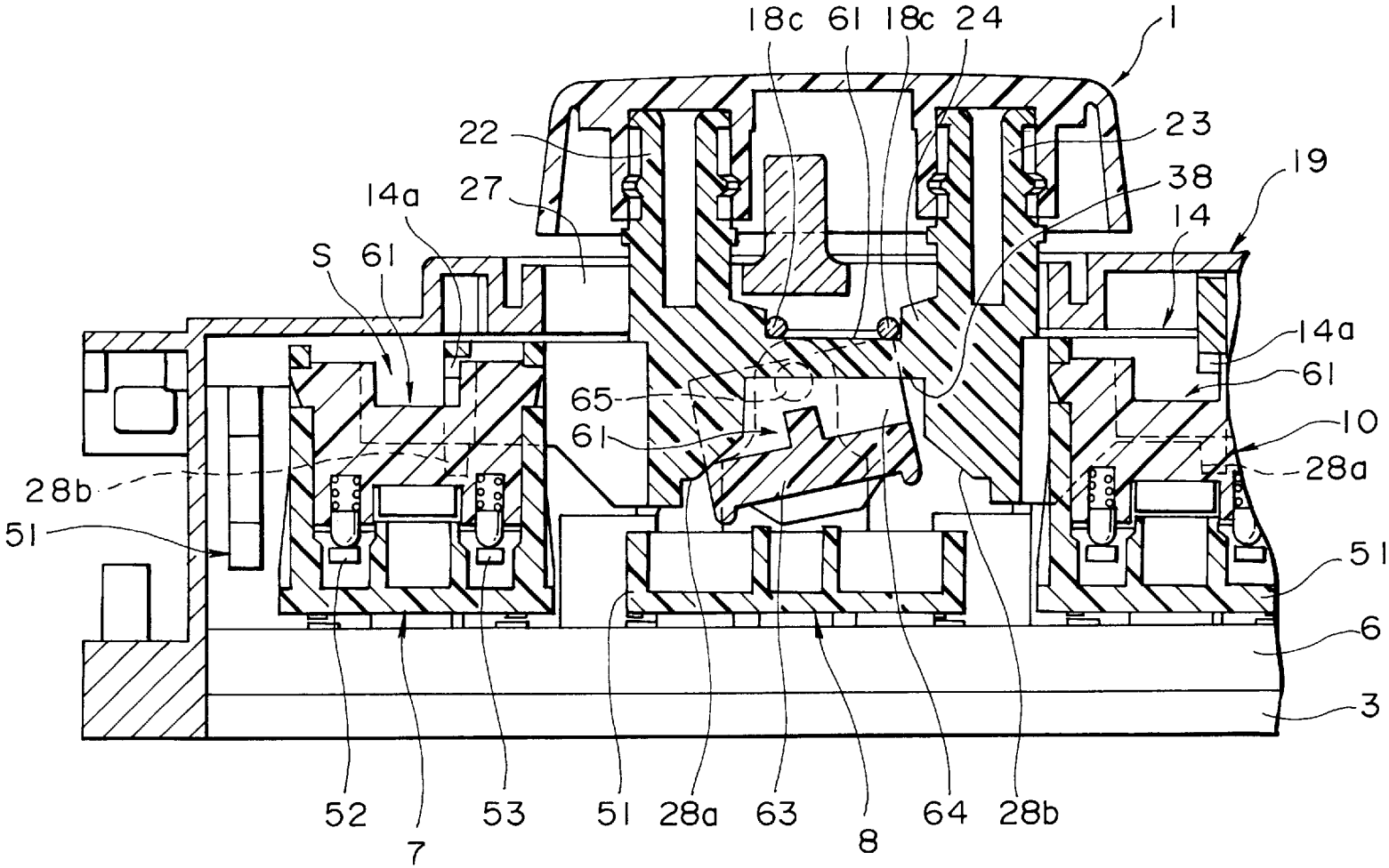
FIG. 6 is a sectional view showing a condition where the vehicle power seat switch is operated.

The operation of the above embodiment will now be described with reference to FIGS. 5 and 6.

To simplify the description, the switch operation for moving the seat section back and forth will be described. As shown in FIG. 5, the seat section operating slider 14 is slidable in the direction of the plane perpendicular to the surface of FIG. 5 by the slide support projections 25 and the inner bottom surface of the housing 19.

When the switching device is not operated as shown in FIG. 5, the lever 61 of the rocking switch 8 for operating the seat section is at the neutral position, and the pair of cams 28*a* and 28*b* of the seat section operating slider 14 are in abutment with the both rocking upper edges of the lever 61. In addition, the press-contact portions 18*c* of the wire springs 18 are elastically brought into contact with the projections 24 of the projecting shafts 22 and 23 of the slider 14 in the direction opposite to each other.

When the seat section operating knob 1 is slid to the right of FIG. 5, the slider 14 also slid to the right. Then, the upper left edge of the lever 61 of the rocking switch 8 is pressed by the cam 28*a* of the slider 14, and consequently, the lever 61 rocks counterclockwise around the shaft 65, as shown in FIG. 6, whereby the rocking switch 8 for operating the seat section is actuated. With the actuation of the rocking switch 8, an electric driving means (now shown) is actuated, so that the seat section moves forward.

When the seat section operating knob 1 is slid to the right, the levers 61 of the rocking switches 7 and 9 for operating the seat section are not actuated.

When the seat operating knob 1 is released, the slider 14 and the lever 61 returns to the positions shown in FIG. 5 due to the restoring forces thereof, whereby the rocking switch 8 is turned off, and a forward movement of the seat section is stopped.

Incidentally, the arrangement of the switching device is such that the rear portion of the seat section moves up and down when the rear portion (the arrow B side of FIG. 3) of the seat section operating knob 1 is moved up and down (in the direction of the arrows U to D), and the rocking switches 7 and 9 are slid when the entire knob 1 is moved up and down (in the direction of the arrows U to D), whereby the entire seat section moves up and down.

In one form of the invention, there is provided a switching device, comprising: laterally slidable sliders 14, 15 and 16; levers 61 rockably supported below the sliders 14, 15, and 16 by rocking fulcrums 65, and rocked in engagement with said sliders 14, 15, and 16; and movable contacts 52 and 53 rocked by the rocking action of the levers 61 so as to be separated from and brought into contact with fixed contacts 59*a* and 59*b*, and 60*a* and 60*b*, wherein a pair of contact portions E of the levers 61 pressed by the sliders 14, 15, and 16 are set lower than the rocking fulcrums 65. This feature of the invention offers the following advantage. The general-purpose rocking switch can be used and slidably operated, and reduction in the thickness of the switching device can be achieved.

In an another form of the invention, there is provided a switching device, wherein recesses S are formed on the upper surfaces of the levers 61 of the rocking switches 7, 8, 9, 10, and 11, and each of the connecting portions 14*a* of the sliders 14, 15, and 16 and each pair of cams 28*a* and 28*b* are arranged partially in the recesses S. This feature of the invention offers the following advantages. A further reduction in thickness of the switching device can be achieved by the length of the sliders 14, 15, and 16 overlapped in the recesses S.

What is claimed is:

1. A switching device, comprising:

a laterally slidable slider;

a lever rockably supported at a base below said slider by rocking fulcrums of said base, and rocked in engagement with said slider;

at least one fixed contact fixed on said base; and at least one movable contact supported between said lever and said fixed contact and rocked by the rocking action of said lever so as to be separated from and brought into contact with said fixed contact, wherein a pair of contact portions of said lever pressed by a pair of cams of said slider are set lower than said rocking fulcrums.

2. A switching device according to claim 1, wherein said lever comprises an upper surface, recesses are formed on the upper surfacers, and said slider is partially arranged in said recesses.

* * * * *

UNITED STATES PATENT AND TRADEMARK OFFICE

CERTIFICATE OF CORRECTION

PATENT NO. : 5,901,839

DATED : May 11, 1999

INVENTOR(S) : Makoto Sasaki et al.

It is certified that error appears in the above-indentified patent and that said Letters Patent is hereby corrected as shown below:

In the Claims

In claim 2, line 3, replace "surfacers" with --surface of said lever--.

Signed and Sealed this

Thirtieth Day of November, 1999

*Attest:*

*Attesting Officer*

Q. TODD DICKINSON

*Acting Commissioner of Patents and Trademarks*